US009967958B2

(12) United States Patent
Creemers et al.

(10) Patent No.: US 9,967,958 B2
(45) Date of Patent: May 8, 2018

(54) LIGHT UNIT WITH BUILT IN ANTENNA

(71) Applicant: PHILIPS LIGHTING HOLDING B.V., Eindhoven (NL)

(72) Inventors: Henricus Mathijs Maria Creemers, Eindhoven (NL); Lambertus Adrianus Marinus De Jong, Eindhoven (NL); Roger Henri Denker, Eindhoven (NL); Dirk Jan Van Kaathoven, Eindhoven (NL); Marijn Geels, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days. days.

(21) Appl. No.: 15/322,931

(22) PCT Filed: Jul. 2, 2015

(86) PCT No.: PCT/EP2015/065113
§ 371 (c)(1),
(2) Date: Dec. 29, 2016

(87) PCT Pub. No.: WO2016/001367
PCT Pub. Date: Jan. 7, 2016

(65) Prior Publication Data

US 2017/0142812 A1 May 18, 2017

(30) Foreign Application Priority Data

Jul. 4, 2014 (EP) ..... 14175814

(51) Int. Cl.
*H05B 37/02* (2006.01)
*F21K 9/62* (2016.01)
(Continued)

(52) U.S. Cl.
CPC ..... *H05B 37/0272* (2013.01); *F21K 9/232* (2016.08); *F21K 9/235* (2016.08);
(Continued)

(58) Field of Classification Search
CPC ..... H05B 37/0272; F21K 9/62; F21K 9/232; F21K 9/235; F21K 9/238; F21V 23/007
See application file for complete search history.

(56) References Cited

U.S. PATENT DOCUMENTS 8,672,512 B2 3/2014 Zhou et al.
2012/0274208 A1* 11/2012 Chen ..... H01Q 1/38 315/34

(Continued)

FOREIGN PATENT DOCUMENTS

CN 202075798 U 12/2011
JP H10341194 A 12/1998

(Continued)

*Primary Examiner* — Douglas W Owens
*Assistant Examiner* — Pedro C Fernandez
(74) *Attorney, Agent, or Firm* — Akarsh P. Belagodu

(57) ABSTRACT

A lighting unit comprises a solid state lighting element (10). An upper housing (18) forms a light mixing chamber (20) over the solid state lighting element (10) and a loop-shaped antenna (22) is held by the upper housing (18), wherein the upper housing (18) comprises a reflective inner wall at least where it defines the mixing chamber (20) and said solid state lighting element (10) is inside said reflective inner wall. This makes use of the component which defines the mixing chamber (20) to hold a loop-shaped antenna (22) in place above the lighting element (10) and therefore away from the heat generated by the lighting element (10) and away from any metallic heat sink or heat spreading components (16).

13 Claims, 7 Drawing Sheets

(51) Int. Cl.

| | |
|---|---|
| ***F21V 23/00*** | (2015.01) |
| ***F21V 23/04*** | (2006.01) |
| ***F21V 29/70*** | (2015.01) |
| ***F21V 17/16*** | (2006.01) |
| ***F21K 9/232*** | (2016.01) |
| ***F21K 9/238*** | (2016.01) |
| ***F21K 9/235*** | (2016.01) |
| ***F21V 3/02*** | (2006.01) |
| ***H01Q 1/42*** | (2006.01) |
| ***H01Q 1/22*** | (2006.01) |
| ***H01Q 1/48*** | (2006.01) |
| *F21Y 115/10* | (2016.01) |
| *F21Y 113/13* | (2016.01) |
| *H01Q 7/00* | (2006.01) |

(52) U.S. Cl.

CPC ..... *F21K 9/238* (2016.08); *F21K 9/62* (2016.08); *F21V 3/02* (2013.01); *F21V 17/164* (2013.01); *F21V 23/007* (2013.01); *F21V 23/0435* (2013.01); *F21V 29/70* (2015.01); *H01Q 1/2291* (2013.01); *H01Q 1/42* (2013.01); *H01Q 1/48* (2013.01); *F21Y 2113/13* (2016.08); *F21Y 2115/10* (2016.08); *H01Q 7/00* (2013.01)

(56) References Cited

U.S. PATENT DOCUMENTS

| | | | | |
|---|---|---|---|---|
| 2012/0293652 | A1 | 11/2012 | Farmer | |
| 2013/0136454 | A1* | 5/2013 | Yu | H05B 33/0803 398/106 |
| 2013/0155664 | A1 | 6/2013 | Kim | |
| 2013/0285544 | A1 | 10/2013 | Molezion | |
| 2014/0168020 | A1* | 6/2014 | Stoytchev | F21V 33/0004 343/721 |
| 2014/0204581 | A1* | 7/2014 | De Jong | H01Q 1/22 362/235 |

FOREIGN PATENT DOCUMENTS

| | | | |
|---|---|---|---|
| JP | 2008103150 | A | 4/2008 |
| WO | 2010140136 | A1 | 12/2010 |
| WO | 2012150589 | A1 | 11/2012 |
| WO | 2013042009 | A1 | 3/2013 |
| WO | 2013153522 | A1 | 10/2013 |

* cited by examiner

LIGHT UNIT WITH BUILT IN ANTENNA

CROSS-REFERENCE TO PRIOR APPLICATIONS

This application is the U.S. National Phase application under 35 U.S.C. § 371 of International Application No. PCT/EP2015/065113, filed on Jul. 2, 2015, which claims the benefit of European Patent Application No. 14175814.4, filed on Jul. 4, 2014. These applications are hereby incorporated by reference herein.

FIELD OF THE INVENTION

The invention relates to a solid state lighting unit, which incorporates an antenna.

BACKGROUND OF THE INVENTION

Wireless control of light sources both for indoor and outdoor applications is becoming increasingly popular. Intelligent lighting has become widespread, and RF communication is a powerful technology used in this remote management of lamps, in particular for domestic and office environments.

By using wireless control, instead of controlling the power supply to the lamp, the light source can be controlled directly by sending an RF control signal to the lighting device.

One example of such a light source is disclosed in US2012/0274208A1. The lighting device comprises a heat sink made of a material with an electrical resistivity being less than 0.01 Ωm (e.g. a metallic heat sink) which is part of the housing and transports heat away from the light source, which is an LED arrangement.

A radio frequency communication circuit connected to an antenna serves to enable RF signal communication to control the device via a remote control. The antenna is formed on a ring shaped PCB which is mounted above the heat sink. US20130136454A1 discloses a LED light source with a reflecting structure and antenna. The light emitting element is placed outside the reflecting structure. The reflecting structure reflects light toward an optical element which can have diffusion particles. The antenna is placed inside the reflecting structure.

SUMMARY OF THE INVENTION

The known arrangement has a large number of components mounted in different positions within the lighting device, which complicates manufacture and assembly.

It would be advantageous to have a lamp with less components and is easy for manufacture and assembly.

The invention is defined by the claims.

According to an aspect of the invention, there is provided a lighting unit comprising:

a solid state lighting element;

a base part which houses driver circuitry for the solid state lighting element;

an upper housing which forms a light mixing chamber over the solid state lighting element; and a loop-shaped antenna, wherein the upper housing comprises retaining members which hold the loop-shaped antenna, and the upper housing (18) comprises a reflective inner wall at least where it defines the mixing chamber (20) and said solid state lighting element (10) is inside said reflective inner wall.

This arrangement mounts a loop-shaped antenna using the housing part which forms the light mixing chamber. In this way, the antenna can be spaced from the driver circuitry. The loop-shaped antenna gives improved performance compared to a stub antenna. Mounting the loop-shaped antenna using the upper housing reduces the number and complexity of the components forming the lighting unit.

The loop-shaped antenna may form an open or closed loop. It may be driven at one end and free at the other forming a monopole structure, or it may be driven in its center with two open loop branches forming a dipole structure, or it may form a closed loop. It should be understood that the desired wavelength/frequency determines the length of the antenna element, and the size of the upper housing can determine how the antenna element with such length is curved into a loop so as to fit the size of the upper housing. Thus, the term open loop should be construed to cover the antenna with the antenna element curved around any suitable angle so as to emit an RF signal. As discussed below, a preferable angle is no less than 270 degree.

In one embodiment, the base part may comprise a heat spreading plate and a heat sink, wherein the heat spreading plate and solid state lighting element are at the top of the base part.

The loop-shaped antenna is mounted above the heat spreading plate and the heat sink so that the radiation pattern is not shielded by the heat sink and heat spreading plate. In this way, improved antenna performance is achieved. Furthermore, the heat sink and heat spreading plate do not need a large opening to allow signals to reach the antenna, so that the heat dissipation function can be optimized.

In one embodiment, the upper housing may for example have legs which are a snap fit into openings of the heat spreading plate.

The advantage of this embodiment is simplifying the assembly.

In one embodiment, the upper housing may be overmoulded over the loop-shaped antenna.

The upper housing and the antenna can thus form a single unit, which simplifies the assembly of the lighting unit.

In one embodiment, the retaining members may be at the top quarter of the height of the upper housing.

In this way, the antenna is held spaced apart from the heat generated by the lighting element and from the heat sink/heat spreading plate, with the antenna for example at the height of the top of the mixing chamber. The antenna is saved from the RF blocking by the heat sink/heat spreading plate.

In one embodiment, the loop-shaped antenna preferably extends around at least 270 degrees.

This enables a near omnidirectional radiation pattern to be achieved, and it also enables the length of the antenna to be increased. The loop can extend substantially in a full circle.

In one embodiment, the lighting element is preferably mounted on a circuit board and the loop-shaped antenna extends in a plane parallel to the circuit board.

The loop-shaped antenna thus extends around the lighting element. This enables the antenna to be fit into the design of a light bulb, extending around a longitudinal axis of the bulb. This enables a compact design but also enables a long antenna length.

In one embodiment, the upper housing preferably has a tubular portion with said reflective inner wall forming the light mixing chamber wherein said solid state lighting element is in the bottom of the tubular portion; a cap portion at the top of the tubular portion, said cap portion extending outward radially from the tubular portion; and said retaining members is at the cap portion.

The upper housing thus performs the dual function of defining the light mixing chamber as well providing a support for the antenna. It thus performs both an electrical/mechanical and an optical function.

In one embodiment, the lighting unit may further comprise a cover over the upper housing and the antenna, wherein the cover has a light scattering part at least over the mixing chamber.

The cover serves to scatter light from the lighting element, for example so that the lighting element, or multiple individual lighting elements, cannot be seen and the light is diffused into more mildly, and the cover may also ensure that the antenna is not visible thereby improving the appearance of the lighting unit.

In one embodiment, the upper housing may have channels leading to the mixing chamber and the cover comprises:

a lid part over the light mixing chamber;

connecting legs which sit in the channels; and a top cover part connected to the lid part by the connecting legs, the top cover part extending over the top of the upper housing and over the antenna.

The lid part functions as the light diffuser for the mixing chamber and emits a major part of the light, the legs convey a minor part of light into the top cover part, and the top cover part can conduct this minor part of light to give a glow effect which also hides the antenna and other internal components. This embodiment is more suitable as a candle lamp.

In one embodiment, the antenna preferably comprises a quarter or three quarter wavelength antenna.

The antenna length is selected as a function of the wavelength to be used, for example the wavelengths of the Zigbee standard. In this case, a three quarter wavelength antenna may be achieved using a loop diameter of approximately 29 mm.

The solid state lighting element preferably comprises a plurality of LEDs.

The mixing chamber serves to mix the light from the multiple LEDs, which may for example be different colours.

The driver circuitry preferably comprises an RF receiver circuit coupled to the antenna for receiving wireless RF commands. These may be in the 1 GHz to 3 GHz band, for example around 2.4 GHz.

These and other aspects of the invention will be apparent from and elucidated with reference to the embodiment(s) described hereinafter.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a lighting unit comprising a solid state lighting element. An upper housing forms a light mixing chamber over the solid state lighting element and a loop-shaped antenna is held by the upper housing. This makes use of the component which defines the mixing chamber to hold a loop-shaped antenna in place above the lighting element and therefore away from the heat generated by the lighting element and away from any metallic heat sink or heat spreading components.

Figure 1:
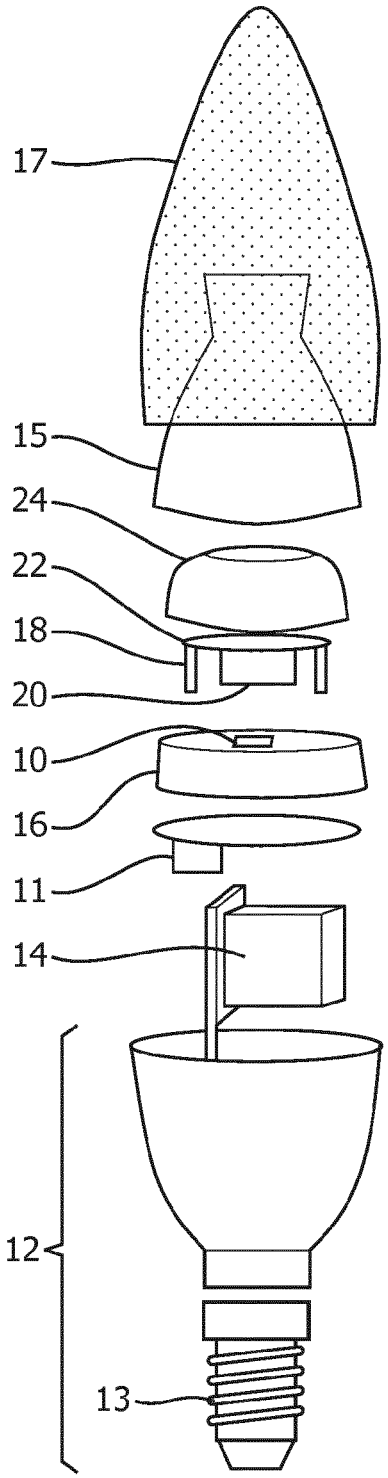
FIG. 1 shows in schematic form the components which make up the lighting unit in accordance with one example of the invention.

FIG. 1 shows in schematic form the components which make up the lighting unit in accordance with one example of the invention.

As shown, the lighting unit is an LED based replacement for a standard candle-type incandescent bulb. It should be noted that the lighting unit according to embodiments of the invention is not limited to a candle bulb.

The lighting unit comprises one or more LEDs 10. These are mounted on a PCB which is supported by a heat spreading plate 16. A further PCB is provided which mounts RF receiver or transceiver circuitry 11. The LEDs may be different colours or they may all be the same. The colour output may also be controllable or it may be fixed.

The LEDs are mounted at the top of a base part 12 of the lighting unit. The base part includes a metallic heat sink for dissipating heat from the LEDs, and in particular from the heat spreading plate 16. The base part 12 includes in this example a screw cap electrical connector 13. Of course, the same design may be applied to a bayonet or pin based connector. The base part houses driver circuitry 14 for the LEDs 10.

The top part of the lighting unit comprises a lens part 15 and an outer cover 17 which may be clear or scattering.

The invention concerns the way an antenna is integrated into the structure. An upper housing 18 is mounted over the LEDs and it forms a light mixing chamber 20 for example for mixing the light output from multiple LEDs or for disguising the point source nature of a single LED by providing a larger area output. By "upper" in this context is mean above the base, i.e. towards the light emitting part of the bulb. Of course in use, the structure may be inverted, with the based at the top and the light emitting dome at the bottom.

A loop-shaped antenna 22 is held by the upper housing. In this way, the antenna is formed suspended above the LEDs and the radiation pattern can be provided without shielding by the heat spreading plate 16 or heat sink in the base part 12.

A cover 24 is provided over the upper housing 18 and the antenna 22, and the cover has a light scattering part at least over the mixing chamber.

FIG. 1 shows the basic components in simplified form and in exploded view.

Figure 2:
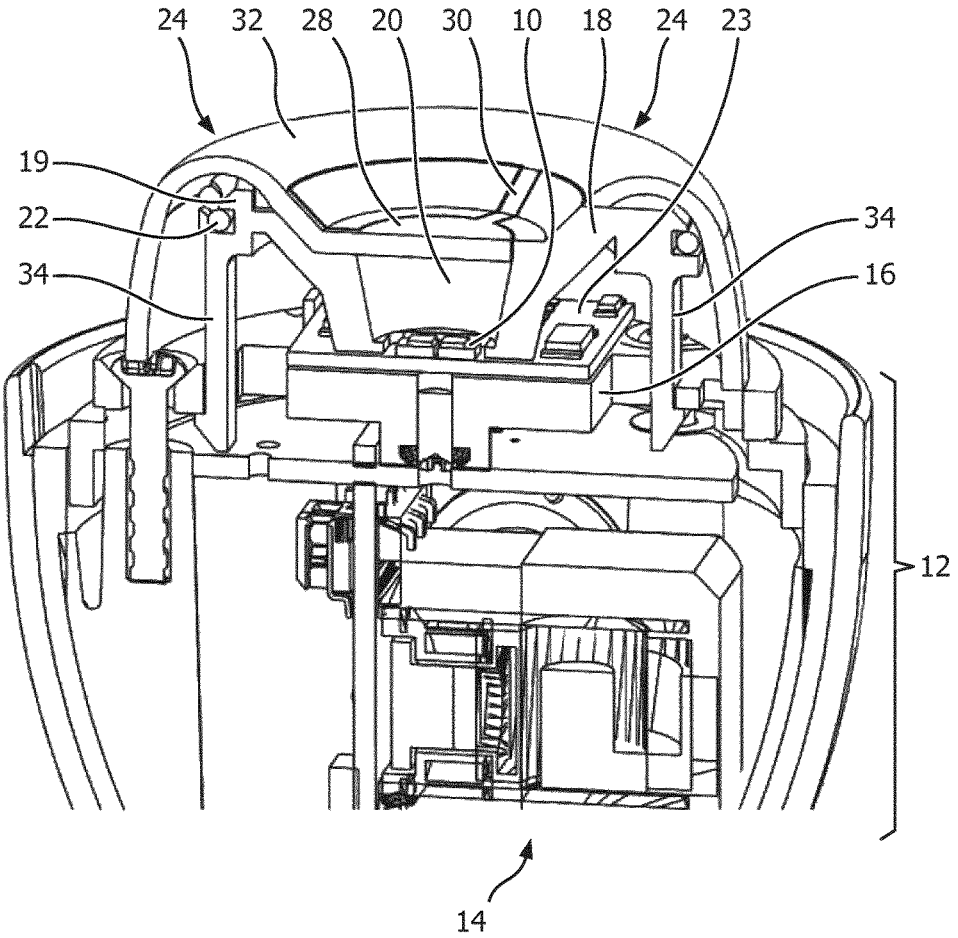
FIG. 2 shows in more detail one example of the structure from the base up to the cover.

FIG. 2 shows in more detail one example of the structure from the base 12 up to the cover 24.

The LEDs 10 are mounted on a respective PCB 23. The mixing chamber 20 is formed over the LEDs 10 and comprises a cylindrical or conical enclosure with a reflective inner wall. The mixing chamber is formed by the molded shape of the upper housing 18. FIG. 2 shows in more detail that the upper housing 18 has retaining members 19, more specifically a recess for gripping the antenna 22 so that the upper housing and the antenna can be assembled as a single component. Indeed, the upper housing can be overmoulded over the loop-shaped antenna 22.

The retaining members 19 are at the top of the upper housing, and more generally at the top quarter of the height of the upper housing. This means they hold the antenna spaced from the heat spreading plate and LEDs. The antenna is held around the radially outside wall of the upper housing 18 to minimize the blocking to the RF signals between the antenna and the heat sink of the lighting unit.

The loop-shaped antenna typically extends around at least 270 degrees but preferably comprises a near complete loop, i.e. preferably more than 300 degrees and even more preferably more than 330 degrees. The loop is in the horizontal plane assuming the longitudinal axis of the bulb is mounted vertically. In other words, the loop-shaped antenna extends in a plane parallel to the circuit board 23 which carries the LEDs 10.

Figure 3:
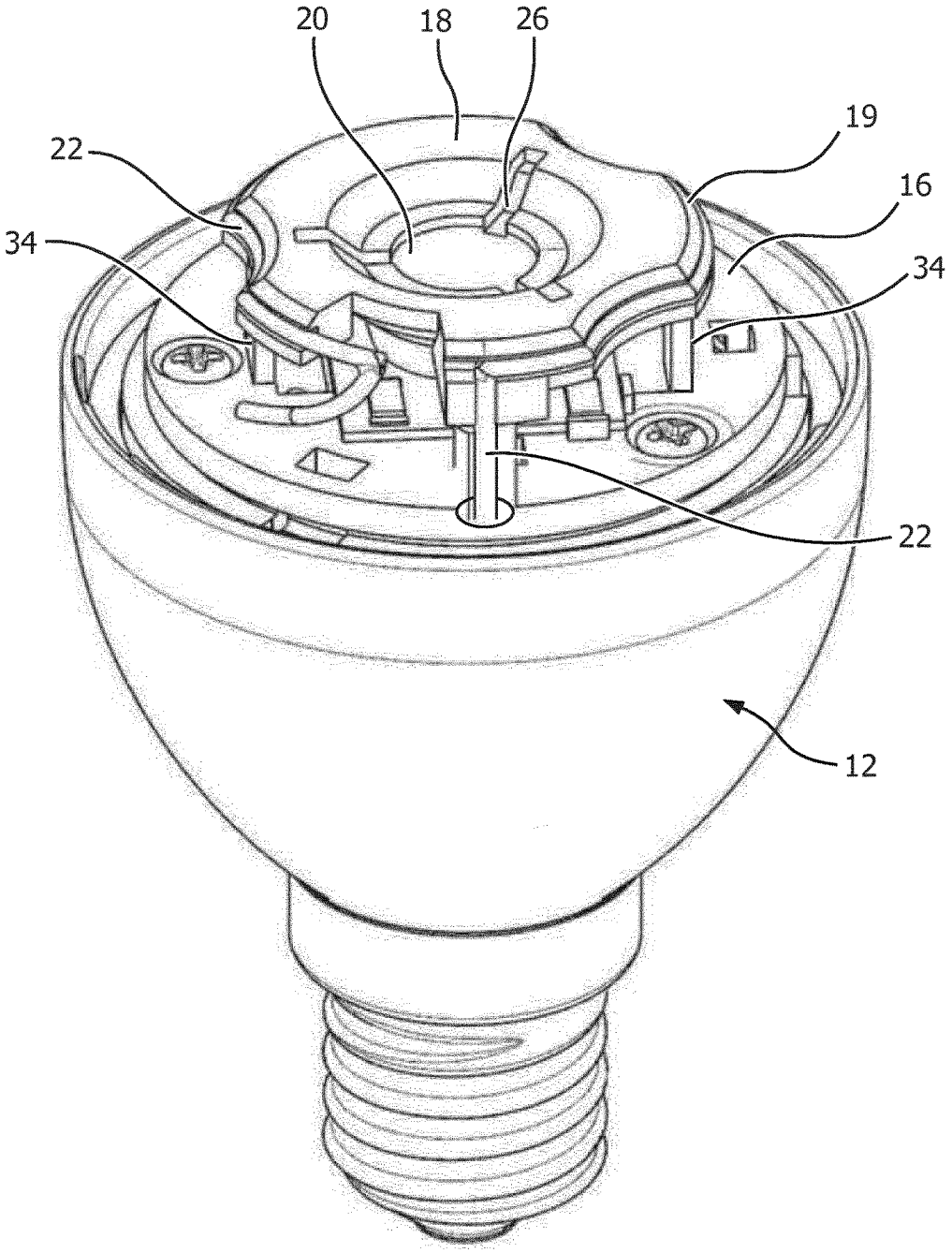
FIG. 3 shows in more detail one example of the structure from the base up to the upper housing.

The antenna in the example shown is a monopole antenna, with a single connection to the RF circuitry at one end and the other end is free. A balun (not shown) is provided between the RF circuitry and the unbalanced antenna. An alternative is a dipole antenna. In this case, two connections are needed to pass to the RF circuitry, but these can be at the same location. Each side of the dipole antenna then extends around 135 to 180 degrees so that they together form the loop shape. The two free ends will then have a tail portion as shown in FIG. 3 for the monopole version. A balanced transmission line can then connect the antenna to the RF circuitry.

The cover 24 is mounted over the upper housing 18 and over the antenna 22, and has a number of functions. A light scattering part 28 is provided over the mixing chamber 20, and this serves to visually hide the individual LED or LEDs from the user. This part 28 is a lid part of the cover.

In addition, the lid part 28 connects to a top cover part 32 by connecting legs 30. The top cover part 32 extends as the top of the cover and the side of the cover, and it extends over the top of the upper housing 18 and over the antenna 22. In this way, the antenna is made not to be visible. This top cover part can be partially transparent to give a glow, with light reaching the top cover part 32 through the connecting legs 30. This gives a subtle lighting effect in addition to the main illumination from the lighting unit.

As mentioned above, the upper housing 18 and the antenna 22 become a single component from the point of view of assembly. The upper housing 18 has legs 34 which are a snap fit into openings of the heat spreading plate 16 so that it can be clipped into place.

FIG. 3 shows the same structure as FIG. 2 but without the cover and in perspective view instead of in cross section.

The upper housing 18 has channels or grooves 26 for receiving the legs 30 of the cover 24. FIG. 3 also shows a retaining member 19 as a continuous recess in which the antenna is fitted. However, there may instead only be discrete points at which the antennas is retained, for example three gripping points for holding the loop-shaped antenna 22. There may of course be fewer or more of these gripping points or indeed a continuous or near continuous loop retaining the antenna in place.

The further PCB which mounts the RF receiver or transceiver circuitry 11 is mounted under the heat spreading plate 16 and for this reason cannot be seen in FIGS. 2 and 3, and it is for example held to the heat spreading plate by a screw. As can be seen in FIG. 3, one end of the loop-shaped antenna passes through a hole in the heat spreading plate 16 to the RF circuitry beneath. The other, free, end has a tail portion.

The heat spreading plate 16 is mounted to the base 12, which functions as the metal heat sink body, by screws which can be seen in FIGS. 2 and 3. The ground plane of the RF circuitry is electrically connected to the heat sink body and heat spreading plate or is capacitively coupled to the heat sink body and heat spreading plate.

The antenna preferably comprises a quarter wavelength or a three quarter wavelength antenna.

In this design, the cover 24 and upper housing 18 can be plastics components, and the heat spreading plate 16 and base 12 are metal components. The optical parts 15,17 may be glass or plastics.

The RF performance of the antenna has been simulated and tested based on prototypes, with the test and simulation results in agreement.

Figure 4:
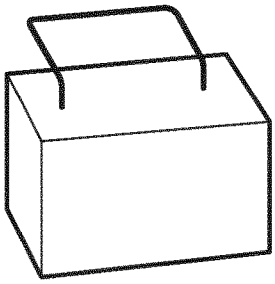
FIG. 4 shows a simulation model for simulating the radio performance/return loss of the lighting unit.

The simulation model shown in FIG. 4 is a rectangular representation needed due the limitations of the used electrical field simulation software. The metal heat sink and top heat spreader act as ground plane for the horizontal whip antenna. They are the block elements in the model.

Figure 5:
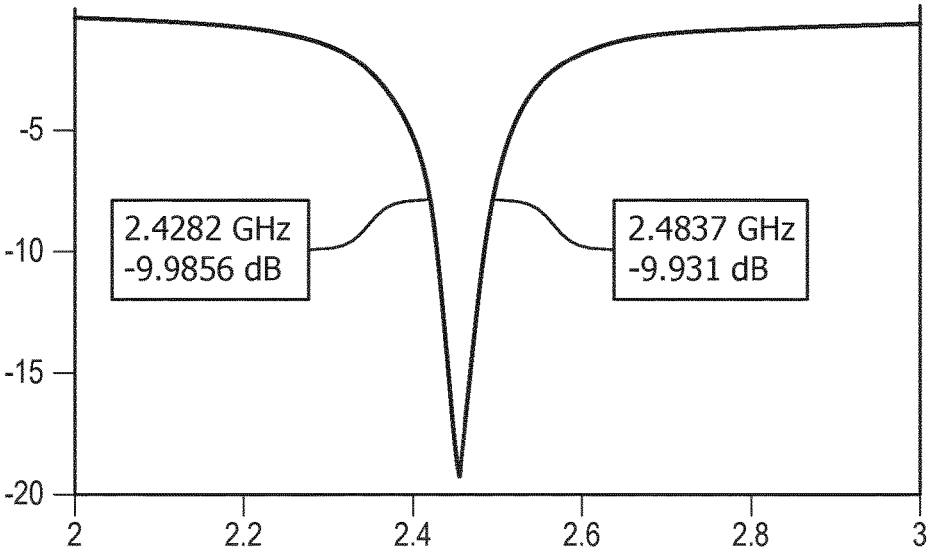
FIG. 5 shows the return loss for the antenna design.

FIG. 5 shows the simulated S11 return loss as a function of frequency (in GHz). The return loss simulation is very promising and shows an S11 value better than −10 dB over the whole Zigbee band. The simulated dimensions for the antenna are a diameter of 33 mm.

Figure 6A:
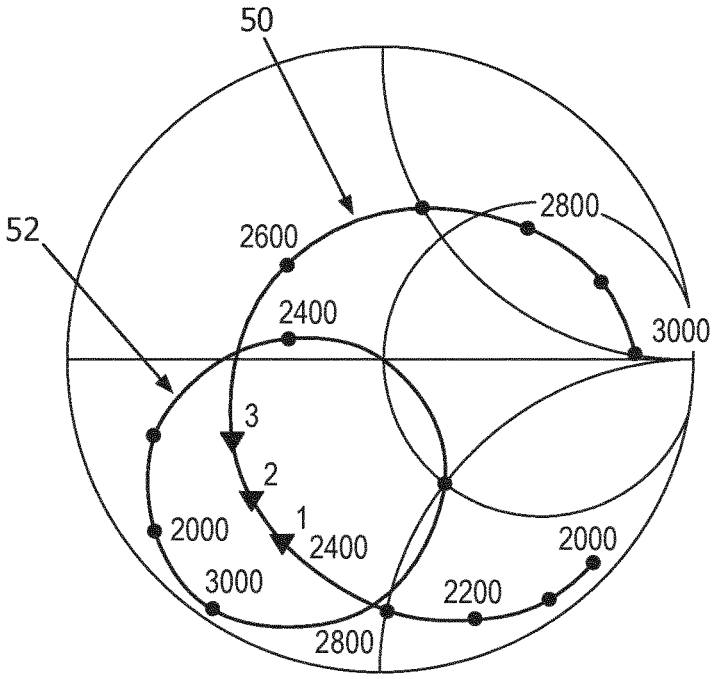
FIG. 6 shows return loss and impedance measurement results for a prototype.
Figure 6B:
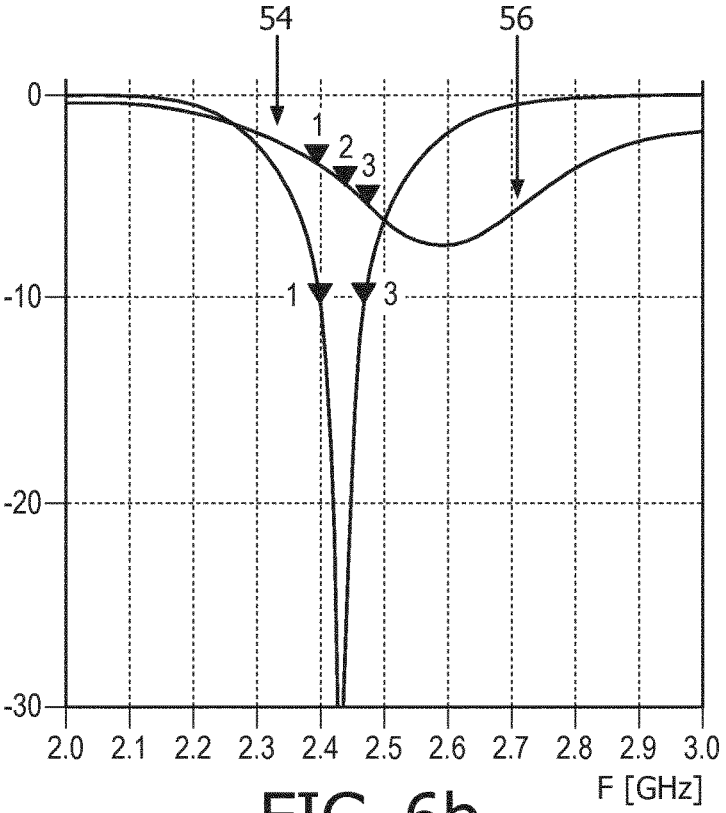

FIG. 6(*a*) shows the impedance FIG. 6(*b*) shows the return loss measured for the prototype. The impedance and return loss of the candle prototype were measured and a wide frequency range with S11<−10 dB could be obtained after matching. Matching is possible with a series matching network or by tuning the antenna dimensions and location. The total length and the location of the end tip of the antenna with respect to the ground plane influence the matching. The end tip to ground plane capacitance can be used as an electrical tuning component.

In FIG. 6(*a*), plot 50 is for a non-matched arrangement and plot 52 is for a matched arrangement by altering the location of the end tip and total length. Point 1 is at 2.400 GHz, point 2 is at 2.440 GHz and point 3 is at 2.480 GHz. The corresponding complex impedance values are 13.95-29.61 j, 14.30-21.46 j and 15.73-12.35 j.

In FIG. 6(*b*), plot 54 is for a non-matched arrangement and plot 56 is for a matched arrangement. Points 1 are at 2.400 GHz, point 2 is at 2.440 GHz and points 3 are at 2.480 GHz. For the non-matched case, point 1 is at a 3.6 dB, point 2 is at 4.2 dB and point 3 is at 5.0 dB. For the matched case, point 1 is at 10.4 dB and point 3 is at 9.8 dB.

The height of the antenna above the ground plane influences the achievable return loss. The antenna impedance is higher when further away from the ground plane. The higher the impedance the better the antenna will radiate. A similar effect is present when increasing the total length of the antenna from a quarter wavelength to three quarter wavelength. The impedance increases and the antenna will radiate better.

Figure 7A:
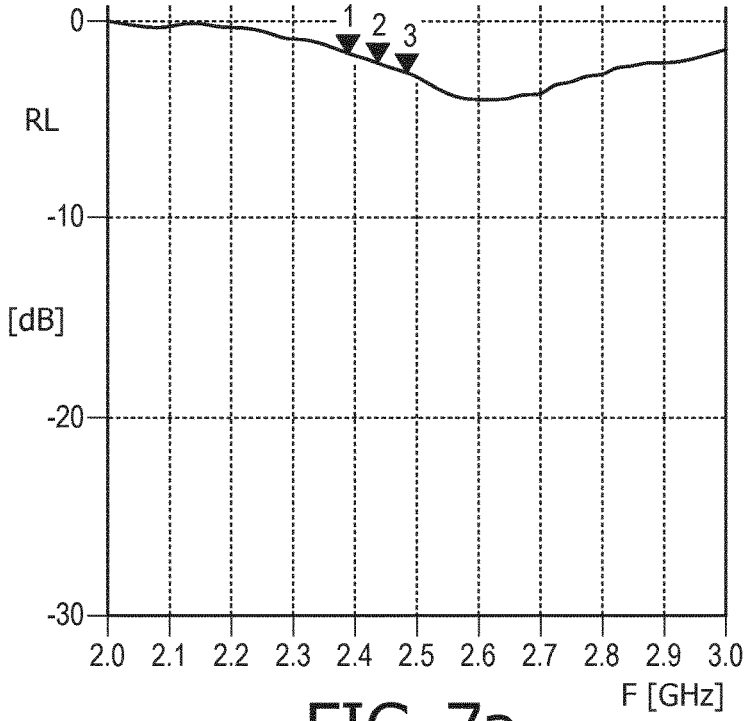
FIG. 7 shows impedance measurement results for two heights above the ground plane in the prototype.
Figure 7B:
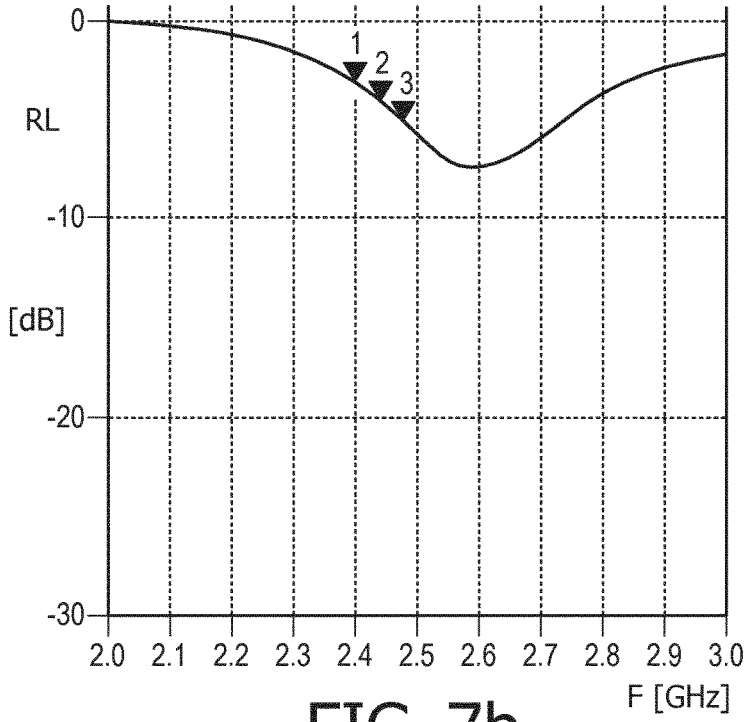

FIG. 7 shows impedance measurement results for two heights above the ground plane in the prototype. FIG. 7(*a*) shows a height of 4 mm and FIG. 7(*b*) shows a height of 5 mm. The points shown as 1, 2 and 3 are again for 2.400 GHz, 2.440 GHz and 2.480 GHz. In FIG. 7(*a*) the corresponding return loss values are 2.0 dB, 2.4 dB and 2.8 dB. In FIG. 7(*b*) the corresponding return loss values are 3.5 dB, 4.2 dB and 5.0 dB.

The antenna length is chosen to be n*¼ λ, where n=1, 3, 5 etc., for a monopole structure, and n=2, 4, etc., for a dipole structure. The horizontal loop construction allows for the implementation of an antenna of length ¾ λ, corresponding to a diameter of approximately 29 mm (29 mm×π=91 mm), without optical interference. This loop size, when taking account of the vertical legs of the antenna and the materials used in the construction, gives a ¾ λ, performance.

The radiation pattern is the most important characteristic for the practical use of the antenna. The simulations and prototypes demonstrate that in all three planes cutting through the central axis of the lamp, the patterns show good uniformity for both polarizations. This gives good RF performance independent of the lighting unit orientation.

Figure 8A:
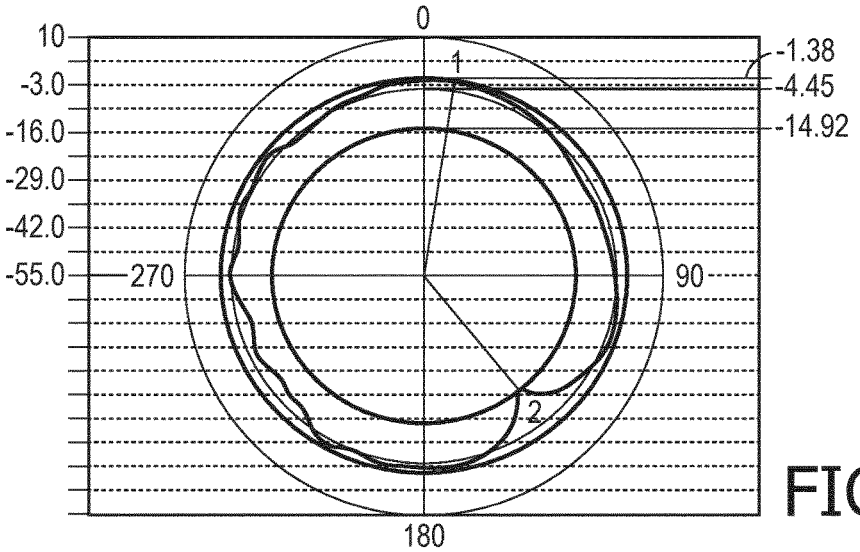
FIG. 8 shows radiation patterns in three orthogonal planes for the prototype.
Figure 8B:
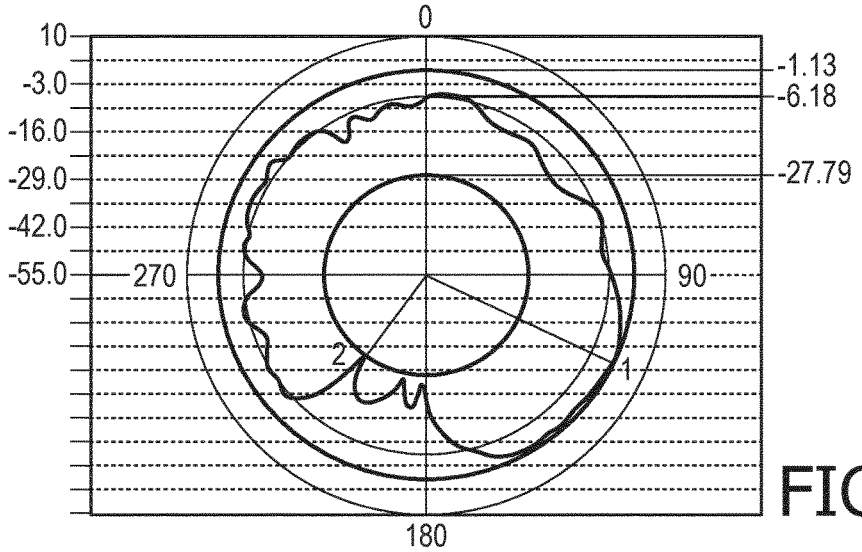
Figure 8C:
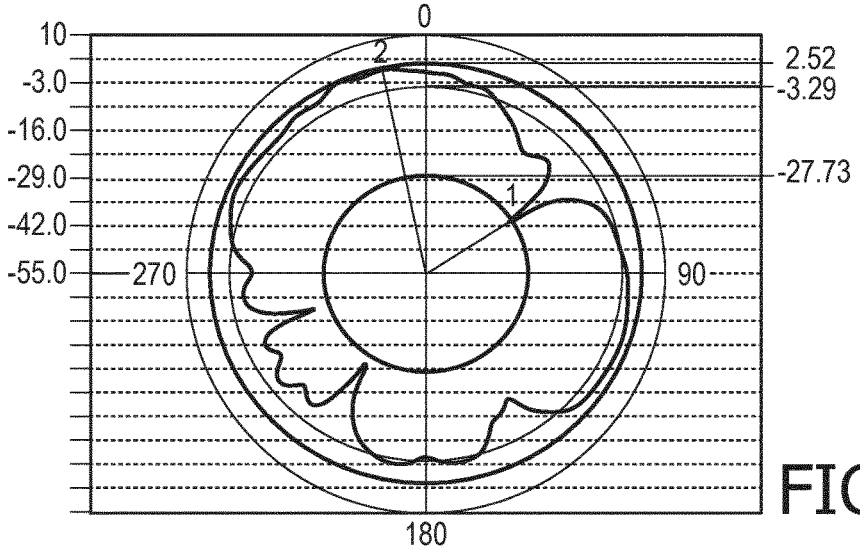

FIG. 8 shows the angular radiation patterns in these three orthogonal planes for the prototype. Defining the axes as x and y in the horizontal plane and z vertically (i.e. up-down in FIG. 1), FIG. 8(*a*) shows the xy plane, FIG. 8(*b*) shows the xz plane and FIG. 8(*c*) shows the yz plane.

In each case, the signal in dBm/m is plotted radially (the numbers are shown up the y-axis). Circles are provided for the minimum and maximum values, and the values are provided. The non-circular plot between the two circles is the antenna response, and the average value is provided (−4.45 dBm/m for FIG. 8(*a*), −6.18 dBm/m for FIG. 8(*b*) and −3.29 dBm/m for FIG. 8(*c*)).

The loop-shaped antenna with a single antenna connection at one end (i.e. electrically in the form of a whip structure) is essentially half a dipole antenna. If mounted horizontally above a perfect ground plane, a quarter-wave whip has a gain twice that (i.e. 3 dB higher) of a half wave dipole, or 5.19 dBi, and a radiation resistance of 36.8 ohms.

However without a ground plane the gain is reduced and the radiation resistance increased. Whips mounted on vehicles use the metal skin of the vehicle as a ground plane. In hand-held devices usually no explicit ground plane is provided, and the ground side of the antenna's feed line is just connected to the ground on the device circuit board. Therefore the device itself, and possibly the user's hand, serves as a rudimentary ground plane. The same principle is used in the antenna above where the heat spreading plate and heat sink are connected to the RF device ground.

The invention is concerned specifically with the physical design of the lighting unit. For this reason, the electrical operation of the driver and RF circuitry is not described in detail. It will be well known to those skilled in the art that antenna matching circuits can be used as part of the electrical circuitry.

Furthermore, multiple antennas may also be used, or indeed a single dipole antenna may be formed as a pair of antenna elements each of the design outlined above but together forming the loop shape.

The invention enables the antenna to be mounted outside of the base, where there is more space and less obstruction. Furthermore, no opening is needed in the heat sink.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A lighting unit comprising:

a solid state lighting element;

a base part which houses driver circuitry for the solid state lighting element;

an upper housing which forms a light mixing chamber over the solid state lighting element; and a loop-shaped antenna, wherein the upper housing comprises retaining members which hold the loop-shaped antenna, wherein the upper housing comprises a reflective inner wall at least where it defines the mixing chamber and said solid state lighting element is inside said reflective inner wall.

2. A lighting unit as claimed in claim 1, wherein the base part comprises a heat spreading plate and a heat sink, wherein the heat spreading plate and solid state lighting element are at the top of the base part.

3. A lighting unit as claimed in claim 2, wherein the upper housing has legs which are a snap fit into openings of the heat spreading plate.

4. A lighting unit as claimed in claim 1, wherein the upper housing is overmoulded over the loop-shaped antenna.

5. A lighting unit as claimed in claim 1, wherein the retaining members are at the top quarter of the height of the upper housing.

6. A lighting unit as claimed in claim 1, wherein the loop-shaped antenna extends around least 270 degrees.

7. A lighting unit as claimed in claim 1, wherein the lighting element is mounted on a circuit board and the loop-shaped antenna extends in a plane parallel to the circuit board.

8. A lighting unit as claimed in claim 1, wherein the upper housing comprises:

a tubular portion with said reflective inner wall forming the light mixing chamber wherein said solid state lighting element is in the bottom of the tubular portion;

a cap portion at the top of the tubular portion, said cap portion extending outward radially from the tubular portion; and said retaining members is at the cap portion.

9. A lighting unit as claimed in claim 1, further comprising a cover over the upper housing and the antenna, wherein the cover has a lid part at least over the mixing chamber.

10. A lighting unit as claimed in claim 9, wherein the upper housing has channels leading to the mixing chamber, the lid part is a light scattering part, and the cover further comprises:

connecting legs which sit in the channels; and a top cover part connected to the lid part by the connecting legs, the top cover part extending over the top of the upper housing and over the antenna.

11. A lighting unit as claimed in claim 1, wherein the antenna comprises a quarter or three quarter wavelength antenna.

12. A lighting unit as claimed in claim 1, wherein the solid state lighting element comprises a plurality of LEDs.

13. A lighting unit as claimed in claim 1, wherein the driver circuitry comprises an RF receiver circuit coupled to the antenna for receiving wireless RF commands.

* * * * *